US006759951B2

(12) United States Patent
Kellner et al.

(10) Patent No.: US 6,759,951 B2
(45) Date of Patent: Jul. 6, 2004

(54) METHOD AND SYSTEM FOR COMMUNICATING AMONG A PLURALITY OF MOBILE ASSETS

(75) Inventors: Steven Andrew Kellner, Melbourne, FL (US); Robert Francis Bryant, Palm Bay, FL (US)

(73) Assignee: General Electric Company

( * ) Notice: Subject to any disclaimer, the term of this patent is extended or adjusted under 35 U.S.C. 154(b) by 57 days.

(21) Appl. No.: 10/278,246

(22) Filed: Oct. 24, 2002

(65) Prior Publication Data

US 2003/0094546 A1 May 22, 2003

Related U.S. Application Data

(60) Provisional application No. 60/332,134, filed on Nov. 16, 2001.

(51) Int. Cl.[7] ..... B60Q 1/00

(52) U.S. Cl. ..... 340/438; 340/502; 340/503; 340/505; 246/187 C

(58) Field of Search ..... 340/438, 447, 340/502, 503, 504, 505, 7.22, 7.23; 455/73, 88; 246/167 R, 187 A, 187 C

(56) References Cited

U.S. PATENT DOCUMENTS 4,553,723 A 11/1985 Nichols et al.
4,582,280 A 4/1986 Nichols et al.
5,039,038 A 8/1991 Nichols et al.
5,681,015 A 10/1997 Kull
5,720,455 A 2/1998 Kull et al.
5,777,547 A 7/1998 Waldrop
5,817,934 A * 10/1998 Skantar ..... 73/121
6,322,025 B1 11/2001 Colbert et al.
6,400,281 B1 6/2002 Darby, Jr. et al.
6,401,015 B1 6/2002 Stewart et al.
6,668,216 B2 * 12/2003 Mays ..... 701/19

* cited by examiner

*Primary Examiner*—Toan N. Pham
(74) *Attorney, Agent, or Firm*—Carl Rowold, Esq.; Enrique J. Mora, Esq.; Beusse Brownlee Wolter Mora & Maire, P.A.

(57) ABSTRACT

A method and system for a lead mobile asset to verify that a remote mobile asset under the control of the lead mobile asset is following a set of command functions broadcast by the lead mobile asset in a command message. The lead and remote mobile assets may be part of a train consist equipped with a distributed power communication system. The method includes determining whether the lead mobile asset has received a status reply message from the remote mobile asset, the reply message transmitted in response to the remote mobile asset's receipt of the command message and including data indicative of at least one operational state of the remote mobile asset. A help command message may be broadcast from the lead mobile asset if the lead mobile asset has not received the status reply message from the remote mobile asset. The help command message may be repeated by a remote mobile asset and a help reply message may be transmitted in response to the help command message from the remote mobile asset in communication loss. The help reply message may include data indicative of at least one operational state of the remote mobile asset and be repeated by another remote mobile asset to the lead mobile asset. The help reply message may be received at the lead mobile asset thereby verifying that the remote mobile asset is following the set of command functions. A system may include control modules configured to allow a distributed power communication function to be performed by one remote mobile asset and a help message repeater function to be performed by another remote mobile asset. These functions may be configured as modular units so that remote mobile assets may execute the functions on a selective basis.

31 Claims, 3 Drawing Sheets

METHOD AND SYSTEM FOR COMMUNICATING AMONG A PLURALITY OF MOBILE ASSETS

CROSS REFERENCE TO RELATED APPLICATION

This application claims priority to a provisional application filed on Nov. 16, 2001 having application No. 60/332,134, which is incorporated herein by reference.

BACKGROUND OF THE INVENTION

This invention relates in general to communication systems and more particularly to a method and system for improving the integrity of a distributed power communication system for controlling the functionality of one or more mobile assets remote from a lead mobile asset.

Communication among locomotives and other cars in a train consist, for example, is important to ensure the coordination of various functions of the locomotives such as throttle control, braking and direction during the train's operation. Radio frequency schemes may be used for such intra-train communication with various combinations of transmitters, receivers and/or transceivers being distributed among the lead or controlling locomotive and the remote locomotives under the control of the lead. During a locomotive distributed power communication operation the lead or command locomotive may transmit control information in a command message to one or more remote or controlled locomotives that are located further back in the train consist. On receipt of the command message, each remote locomotive may transmit a reply message back to the lead locomotive including operational status information of that remote. The operational status message verifies to the lead locomotive that the remote is operating in response to the command message instructions. If the lead locomotive is satisfied that it has received a reply message from all of the remote locomotives then the lead locomotive may declare that all remote locomotives are following the command message instructions. Alternatively, if the lead locomotive does not receive a reply message from each remote unit within a certain period of time then the lead locomotive may assume that communication has been lost and that one or more of the remote locomotives is not following the command message instructions. However, the lead locomotive not receiving a reply message from one or more remote locomotives does not necessarily mean that those locomotives are not following the command message instruction.

For example, locomotive train consists traverse a wide range of topographies including mountainous terrain and other geographical areas having physical features, such as tunnels, that may cause a loss of communication among locomotives in the train consist. When traveling through such areas the likelihood of RF communication loss among the lead and remote locomotives increases. Appropriately configured wayside RF repeaters may be placed near geographical areas that are known to cause communication difficulties in order to improve intra-train communication when a train consist passes through those areas. This increases the likelihood that a lead locomotive will receive reply messages from remote locomotives. Such wayside RF repeaters are relatively expensive to install and maintain and may be cost prohibitive to use in geographical areas that are difficult to access or that otherwise lack the necessary infrastructure to support their operation. Such wayside RF repeaters are also limited to operating only in their permanent physical geographic location. Train consists operating in areas lacking wayside RF repeaters are typically limited in their length to better ensure RF communication among the locomotives in the consist. Limiting the length of a train consist is disadvantageous to railroads that may otherwise maximize the length of a consist to meet customer demands, improve operating efficiency and maximize revenues.

In view of the above, it would advantageous to provide a reliable, cost effective method and system for improving the integrity of a distributed power communication system for verifying to the operator of a lead locomotive that all remote locomotives are following a set of command instructions.

BRIEF DESCRIPTION OF THE INVENTION

Exemplary embodiments of the present invention fulfill the foregoing needs by providing in one aspect thereof a railroad distributed power communication method for wireless transceiver units at spaced locations along a train, with the train having a lead transceiver unit transmitting commands, remote transceiver units spaced from the lead and for which direct communication with the lead unit may be uncertain. The at least one intermediate transceiver unit may be located between the lead unit and at least one remote unit where the intermediate unit constitutes a repeater for repeating messages between the lead unit and at least one of the remote units. The method allows for verifying that a remote unit under the control of the lead unit is following a set of command functions broadcast by the lead unit in a command message by determining whether the lead unit has received a status reply message from the remote unit where the status reply message is transmitted in response to the remote unit's receipt of the command message. The status reply message may include data indicative of at least one operational state of the remote unit. A help command message may be transmitted from the lead unit to the repeater in the event the lead unit has not received the status reply message from the remote unit. The help command message may be repeated from the repeater to the remote unit. A help reply message may be transmitted from the remote unit to the repeater in response to the remote unit's receipt of the repeated help command message. The help reply message may be repeated from the repeater to the lead unit, the help reply message including data indicative of at least one operational state of the remote unit and the help reply message may be received at the lead unit thereby verifying that the remote unit is following the set of command functions.

In one aspect a method for communicating and verifying commands among a plurality of locomotives within a train consist is provided that comprises broadcasting a command message from a lead locomotive to at least one remote locomotive then determining whether the lead locomotive receives a status reply message including data indicative of at least one operational state of the remote locomotive. If the lead locomotive does not receive the reply message within a predetermined period of time after transmitting the command message then the lead may transmit a help command message. A help reply message may be transmitted from the remote locomotive in response to receipt of the help command message. The help reply message may be repeated from a remote locomotive consist and received by the lead locomotive. The help reply message may include data indicative of the at least one operational state of the first remote locomotive consist.

In another aspect a method for communicating among a plurality of mobile assets and verifying receipt of a message by at least one of the mobile assets is provided which comprises broadcasting a command message to the plurality of mobile assets then determining whether a lead mobile asset receives a status reply message from each of a predetermined group of the plurality of mobile assets. A help command message may be broadcast if the lead mobile asset did not receive a reply message from at least one of the predetermined group. The help command message may be repeated by at least one of the plurality of mobile assets and include data indicative of the identity of the mobile asset for which the lead mobile asset did not receive the reply message. A help reply message may be transmitted from the mobile asset for which the lead mobile asset did not receive the reply message, the help reply message being transmitted in response to receipt of the help command message. The help reply message may be repeated by at least one of the plurality of mobile assets and received by the lead mobile asset.

In another aspect a system for a lead locomotive to verify that a remote locomotive under the control of the lead locomotive is following a set of command functions broadcast by the lead locomotive in a command message, the lead and remote locomotives being part of a train consist equipped with a distributed power communication system is provided, which comprises a control module for determining whether the lead locomotive has received a status reply message from the remote locomotive where the status reply message is transmitted in response to the remote locomotive's receipt of the command message and includes data indicative of at least one operational state of the remote locomotive. A transmitter for transmitting a help command message from the lead locomotive to a locomotive consist within the train consist in the event the lead locomotive has not received the status reply message from the remote locomotive. A radio unit for repeating the help command message from the locomotive consist to the remote locomotive and a transmitter for transmitting a help reply message from the remote locomotive to the locomotive consist in response to the remote locomotive's receipt of the repeated help command message. A radio unit for repeating the help reply message from the locomotive consist to the lead locomotive, the help reply message including data indicative of at least one operational state of the remote locomotive and a receiver for receiving the help reply message at the lead locomotive thereby verifying that the remote locomotive is following the set of command functions.

The exemplary embodiments allow for cost effective and reliable communication among a plurality of mobile assets, such as locomotives within a train consist, for example. Train consists employing exemplary embodiments may increase their length, for example, and retain the ability to verify that all locomotives under the control of the lead locomotive are following instructions included in a command message. A repeating function of the exemplary embodiments is available one hundred percent of the time that is reliable, conserves communication resources and optimizes use of available on-board equipment.

DETAILED DESCRIPTION OF THE INVENTION

Figure 1:
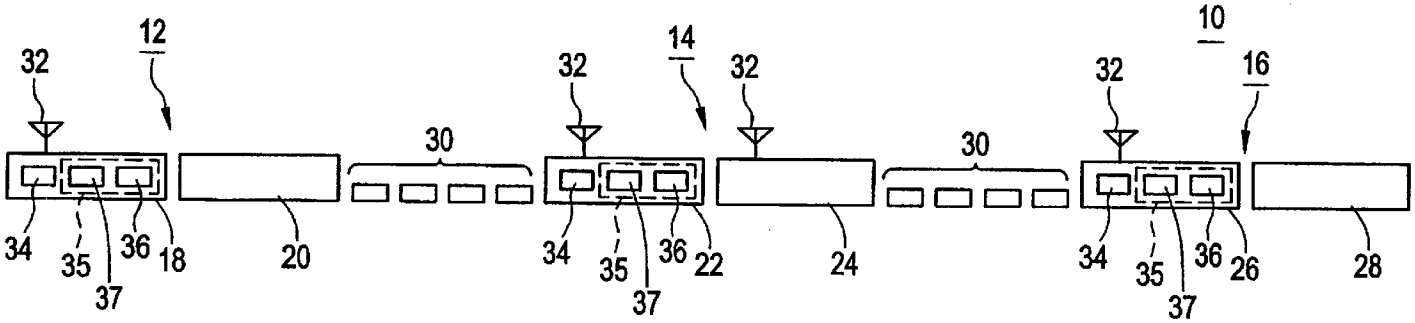
FIG. 1 illustrates a schematic diagram of a train consist and an exemplary embodiment of the present invention.

FIG. 1 illustrates an exemplary train consist generally referred to as 10 that is used to illustrate various aspects of the present invention. It will be recognized by those skilled in the art that train consist 10 may be configured in many ways as a function of the length of the train consist 10, the amount of goods it is transporting, the geographical terrain over which it will travel, on-board telecommunication equipment as well as other factors. Train consist 10 may include by way of example three discrete locomotive consists 12, 14 and 16 that may be used to implement aspects of the present invention. In one exemplary embodiment the lead locomotive consist 12 may include a lead locomotive 18 and a lead trail locomotive 20, the remote locomotive consist 14 may include a remote locomotive 22 and a remote trail 24, and the remote locomotive consist 16 may include a remote locomotive 26 and a remote trail 28. Alternate embodiments allow for each of the lead and remote locomotive consists 12, 14 and 16 to include only one locomotive or they may each include a plurality of locomotives depending on the needs of the specific train consist 10. A plurality of rail cars 30 may be situated between the respective lead and remote locomotive consists 12, 14 and 16.

One embodiment allows for lead locomotive 18, remote locomotive 22, remote trail locomotive 24 and remote locomotive 26 to be equipped with appropriately configured hardware and software to allow for a distributed power communication scheme, such as one implemented by the assignee of the present invention, to be established among the locomotives. For example, as shown in FIG. 1, each locomotive 18, 22, 24 and 26 may include one or more RF antennas 32, one or more radio or transceiver units 34 that may operate in conjunction with a control module 35 that includes a processor 36 and equipment 37 for monitoring and controlling the locomotive. The distributed power communication scheme or system allows for lead locomotive 18 to function as the controlling or command locomotive for controlling remote locomotives in train consist 10 such as locomotives 22 and 26, for example. The distributed power communication system is enabled through the linking of respective radio or transceiver units on-board the respective locomotives 18, 22, 24 and/or 26. A primary objective of radio linking is to ensure respective locomotives receive only those messages intended for them. In general, this is accomplished using a set of unique identifiers that are transmitted in radio messages as will be recognized by one skilled in the art. All radio communication that follows the linking process may include address codes to ensure message acceptance only by the desired message destination radio unit. Each radio unit, whether assigned to a lead or remote locomotive, is programmed with an address code, which is not duplicated. This ensures that multiple lead units cannot transmit command radio messages that are accepted by improper remote units because of identical address codes.

In this respect, after linking the lead locomotive 18 radio unit with the radio units of one or more remote locomotives 22, 24 and 26 for example, lead locomotive 18 may broadcast command messages over the distributed power communication system during operation of the train consist to provide operational instructions to the remote locomotives 22 and 26. The linking protocol may enable remote locomotive 22 and/or remote locomotive 24 to function as status reply message repeaters depending on their respective on-board equipment and mission objectives. Status reply messages are those messages transmitted from respective remote locomotives, such as 22 and 26, in response to receipt of command messages from the lead locomotive 18. For example, one embodiment allows for equipment on-board remote locomotive 22 to function as the distributed power communication system that controls the operational state of remote 22 and equipment on-board the remote trail locomotive 24 to function as a status reply message repeater only. The remote trail locomotive 24 may be linked during the linking process with a proper protocol so that locomotive 24 knows the unique address of the lead locomotive 18. This configuration provides a cost savings in that the on-board equipment of the remote locomotive 22 does not have to be programmed and tested to function as both the distributed power communication system and the status reply repeater. In this respect, equipment on-board the remote locomotive 24 may be configured to perform the status reply message repeater function while remote locomotive 22 retains the distributed power communication function. This separation of functionality allows for the distributed power function to operate independent of the status reply repeater function. Consequently, each independent function may be configured as a modular unit, which allows for easy implementation and presents a very low to non-existent risk that one function may adversely impact the other function during operation. This modularity also enables a railroad operator, for example, to utilize the independent functions without having to upgrade their entire fleet of locomotives to accommodate systems configured to perform both functions together. The modular units may be selectively installed and/or configured on a locomotive-by-locomotive basis. An alternate embodiment allows for both the remote locomotives 22 and 24 to be equipped so that each may simultaneously perform the functions of the distributed power communication system and the status reply repeater. In yet another embodiment, the locomotive consist 14, for example, may comprise a single locomotive equipped with the distributed power communication system and status reply message repeater function. These various embodiments provide the operator of a fleet of locomotives and/or train consists a high degree of flexibility in configuring a train consist with locomotives capable of functioning in a distributed power communication mode or a help message repeater mode, or both, or neither.

For efficient and safe operation of the train consist 10 an operator of the lead locomotive 18 needs to know whether the remote locomotives 22 and 26 are following the operational instructions or command functions broadcast by the lead locomotive 18. This may be accomplished in a reply status message from each remote locomotive 22 and 26 informing the operator of the operational or command function status of the respective remote locomotives. In some instances, for example, the lead locomotive 18 may not receive a status reply message from one of the remote locomotives 22 or 26 in a timely manner in which case the operator of the lead locomotive 18 may assume that communication with one or more respective remotes 22 and 26 has been lost. If communication loss occurs the operator needs to verify the operational status of each of the remote locomotives 22 and 26 as quickly as possible so that the operator may avoid executing unnecessary remedial action.

Figure 2A:
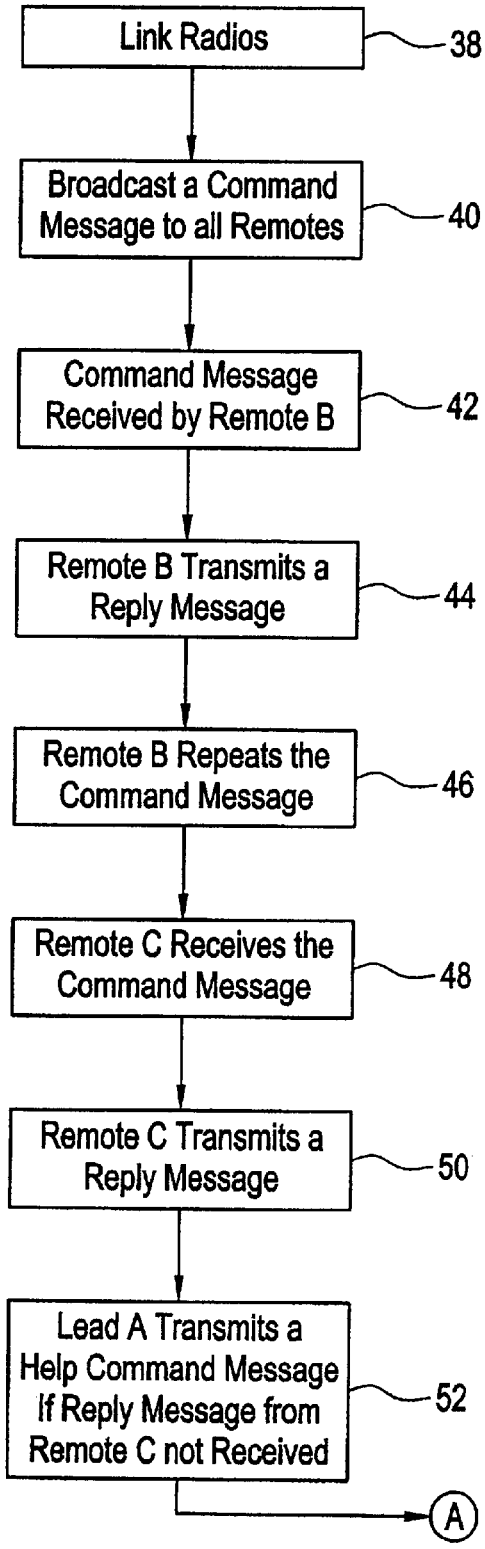
FIG. 2 illustrates a flow chart of an exemplary embodiment of one aspect of the present invention.
Figure 2B:
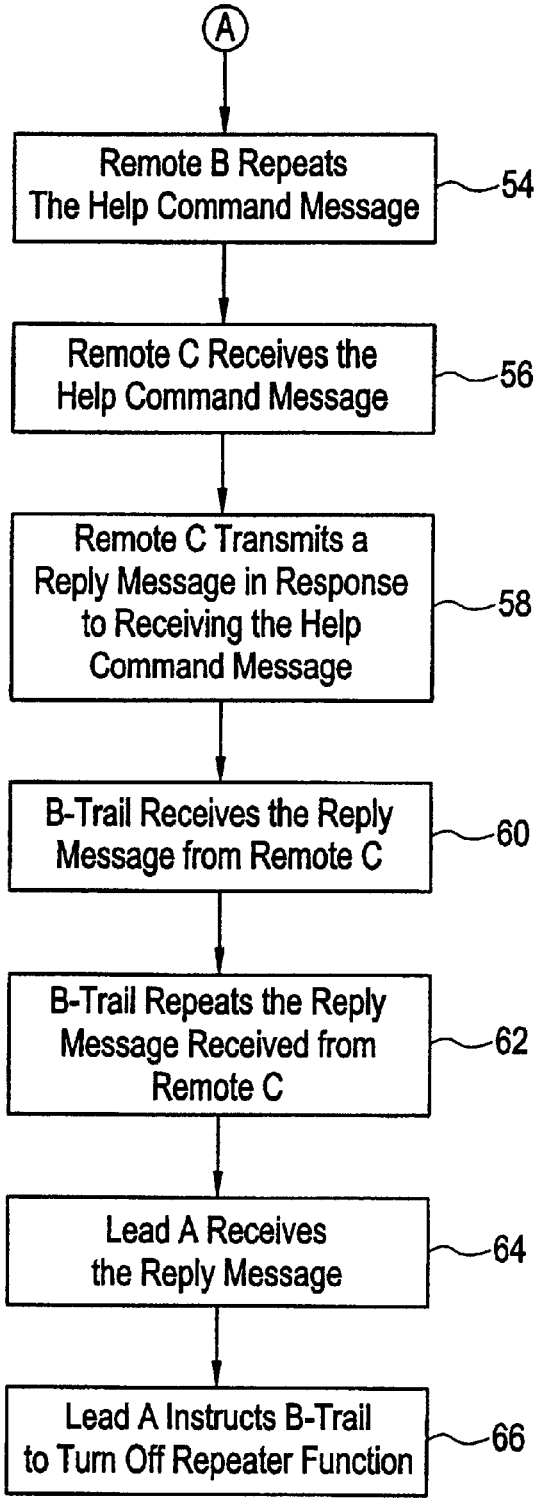

FIG. 2 allows for in step 38 the respective radio or transceiver units 34 of the locomotives to be linked as described above. Step 40 allows for the lead locomotive 18 or lead transceiver unit 34 to broadcast a command message to all of the remote locomotives in a train consist. By way of example, lead locomotive 18, represented in FIGS. 2A and 2B as Lead A, may broadcast a command message to remote locomotives 22 and 26 in step 40, which are represented in FIGS. 2A and 2B as Remote B and Remote C, respectively. The command message may include data indicative of command functions or operational instructions, for example, from the lead locomotive 18 to the remote locomotives 22 and 26 or remote transceiver units 34, in which the lead locomotive 18 commands the remote locomotives to go to or stay in a particular operational state. Command messages may be broadcast under the protocol of the distributed power communication scheme such as once every twenty seconds, for example, or whenever the lead locomotive 18 determines that the remote locomotives 22 and/or 26 should immediately go to a different operational state. A remote locomotive, such as the remote locomotive 22, or remote transceiver unit 34, may receive the command message in step 42. Step 44 allows for remote locomotive 22 or remote transceiver unit 34 to transmit a status reply message to a lead locomotive, such as the lead locomotive 18, the status reply message may include data indicative of at least the operational or command function status of the remote locomotive 22 or remote transceiver unit 34. The remote locomotive 22 may in step 46 repeat the command message as part of the status reply message. It will be recognized by those skilled in the art that the command message may be repeated as a separate message prior to transmission of the status reply message. The command message may be repeated by the remote locomotive 22 to increase the likelihood that another remote locomotive, such as the remote locomotive 26, receives the command message, which may receive the command message in step 48. On receipt of the command message, step 50 allows for the remote locomotive 26 or a remote transceiver unit 34 to transmit a status reply message, the status reply message may include data indicative of at least the operational or command function status of the remote locomotive 26 or a remote transceiver unit 34. The status reply message transmitted by the remote locomotive 26 may not be received by the lead locomotive 18 or lead unit 34 within a predetermined threshold of time established as part of the distributed power communication system. In this respect, step 52 allows for the lead locomotive 18 or lead unit 34 to transmit a help command message requesting help from a remote locomotive configured with an RF message repeater function, such as a remote trail locomotive 24 for example. The request may be transmitted to an intermediate transceiver unit such as 34 on-board a remote locomotive trail locomotive 24, for example. The help command message may be transmitted in the event the lead locomotive 18 does not receive a status reply message from a remote locomotive such as remote locomotive 26 within the predetermined threshold of time. The remote trail locomotive 24 or intermediate transceiver unit 34 may then repeat the help command message to the remote locomotive in communication loss with the lead locomotive 18. The help command message transmitted in step 52 may include data indicative of the unique address for the respective remote locomotive in communication loss with the lead locomotive 18. The remote trail locomotive 24 may use the unique addresses of each respective locomotive within train consist 10 to determine which messages to repeat and which messages not to repeat. In this respect, the on-board equipment of remote trail locomotive 24 may be configured to ignore all messages from the lead and remote units of other train consists, for example, due to their different unique addresses. Alternate embodiments allow for the lead locomotive 18 to transmit a help command message asking for help from a remote repeating locomotive based on conditions other than the lead 18 not having received a status reply message from a remote locomotive. For example, a help command message may be transmitted if the status reply message received from remote locomotive 26 is incomplete or for any other condition that may cause the operator of the lead locomotive 18 to question whether the remote locomotive 26 is following the operational instructions of the command message.

One embodiment allows for the help command message transmitted by the lead locomotive 18 to be received by the remote locomotive 22. Remote locomotive 22 may then repeat the help command message in step 54 to increase the likelihood that the remote locomotive 26, which in this example is in communication loss with the lead locomotive 18, receives the help command message. The remote locomotive 26 may receive the help command message in step 56. Step 58 allows for the remote locomotive 26 to transmit a help reply message in response to receipt of the help command message. The help reply message may include data indicative of at least the operational or command function status of the remote locomotive 26. One embodiment allows for in step 60 the help reply message to be received by the remote trail locomotive 24. On receipt of the help reply message from remote locomotive 26, step 62 allows for the remote trail locomotive 24 to repeat the help reply message received from remote locomotive 26. The lead locomotive 18 may receive the help reply message in step 64 thereby allowing the operator of the lead locomotive 18 to verify that the remote locomotive 26 is following the command instructions. On verification, the lead locomotive 18 may transmit a command message to the remote trail locomotive 24 to turn off the repeater function in step 66 to conserve communication resources. It will be recognized by those skilled in the art that aspects of the steps of FIG. 2 may be implemented using various combinations of lead, intermediate and remote transceiver units 34 distributed among the locomotives and/or rail cars 30 of the train consist. In this respect, a lead unit 34 may verify that a remote unit 34 is following a set of command functions in accordance with the distributed power communications protocol, for example. The remote unit 34 may be configured so that its operational status is indicative of whether an associated locomotive is following the set of command functions.

Figure 3:
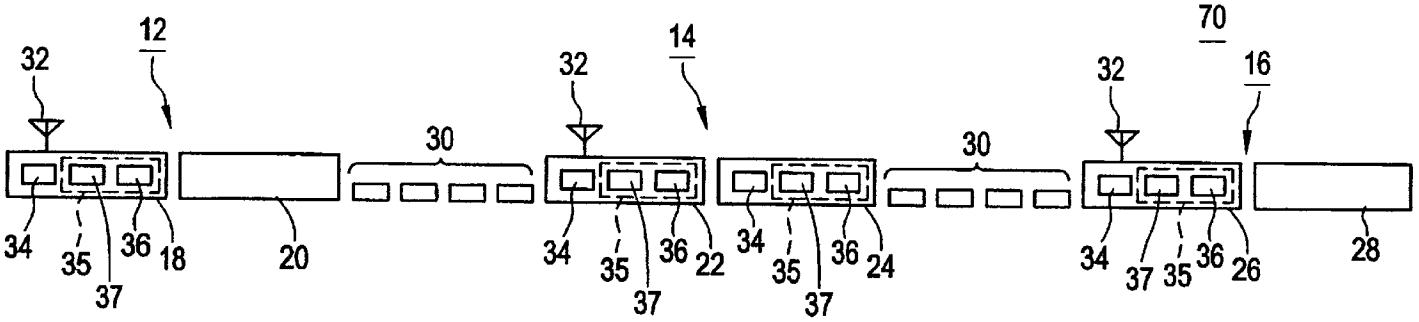
FIG. 3 illustrates a schematic diagram of a train consist and an exemplary embodiment of the present invention.

FIG. 3 illustrates another embodiment of a train consist 70 that is configured substantially the same as the train consist 10 of FIG. 1. One embodiment allows for the locomotive consist 14 to comprise one locomotive, such as first remote locomotive 22 for example, equipped to perform the function of the distributed power communication system and the message repeater for the help command message and the help reply message. This configuration allows for remote locomotive 24 to be removed from the locomotive consist 14 while allowing for the train consist 70 to retain full distributed power communication and message repeater functionality.

One aspect allows for existing distributed power communication equipment on-board a locomotive to be selectively switched among a distributed power mode, a help message repeater mode and a standby mode. In this respect, a remote locomotive may simultaneously function in a distributed power and a help message repeater mode, it may function in one of these modes only or it may function in the standby mode where it functions as neither. This aspect allows for great flexibility in choosing the configuration of locomotives within a train consist. The selectively switching aspect may be implemented with executable software modules, included on floppy disks or CDs for example, designed to permit the equipment to function in the desired mode or modes.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A railroad distributed power communication method for wireless transceiver units at spaced locations along a train, with the train having a lead transceiver unit transmitting commands, remote transceiver units spaced from the lead and for which direct communication with the lead unit may be uncertain, and at least one intermediate transceiver unit located between the lead unit and at least one remote unit, the intermediate unit constituting a repeater for repeating messages between the lead unit and at least one of the remote units, the method verifying that a remote unit under the control of the lead unit is following a set of command functions broadcast by the lead unit in a command message, the method comprising:

determining whether the lead unit has received a status reply message from the remote unit, the status reply message transmitted in response to the remote unit's receipt of the command message and including data indicative of at least one operational state of the remote unit;

transmitting a help command message from the lead unit to the repeater in the event the lead unit has not received the status reply message from the remote unit;

repeating the help command message from the repeater to the remote unit;

transmitting a help reply message from the remote unit to the repeater in response to the remote unit's receipt of the repeated help command message;

repeating the help reply message from the repeater to the lead unit, the help reply message including data indicative of at least one operational state of the remote unit; and receiving the help reply message at the lead unit thereby verifying that the remote unit is following the set of command functions.

2. The method of claim 1 further comprising:

locating the repeater on-board a locomotive consist within the train.

3. The method of claim 2 wherein the repeater is located on-board a remote trail locomotive of the locomotive consist.

4. The method of claim 1 further comprising:

locating the repeater on-board a remote trail locomotive of a locomotive consist of the train; and locating one of the remote transceiver units on-board a first remote locomotive of the locomotive consist.

5. The method of claim 1 further comprising:

configuring a first remote transceiver unit on-board a locomotive consist for interoperability with the lead unit and the remote unit to function as part of a distributed power communication system of the train; and locating the repeater on-board the locomotive consist.

6. The method of claim 5 further comprising:

configuring the lead unit to instruct the intermediate transceiver unit to turn off the repeater after the lead unit is in receipt of the help reply message.

7. The method of claim 1 further comprising:

transmitting the help command message from the lead unit if the lead unit has not received the status reply message within a predetermined amount of time after broadcasting the command message.

8. The method of claim 1 further comprising:

configuring at least one of the remote transceiver units to be selectively switched between a distributed power communication mode, a help message repeater mode and a standby mode wherein the at least one remote transceiver unit will function as the repeater when set in the help message repeater mode;

configuring the at least one intermediate transceiver unit to be selectively turned on and off if the at least one remote transceiver unit is set in the help message repeater mode; and providing a control module configured for selectively switching the at least one remote transceiver unit between modes and turning the at least one intermediate transceiver unit on and off.

9. The method of claim 1 further comprising:

locating the remote unit on-board a remote locomotive for which a lead locomotive needs to verify is following the set of command functions; and configuring the data indicative of at least one operational state of the remote unit to be indicative of whether the remote locomotive is following the command functions.

10. A method for communicating and verifying the status of command functions among a plurality of locomotives within a train consist, the method comprising:

broadcasting a command message from a lead locomotive to at least one remote locomotive of the train consist;

determining whether the lead locomotive receives a status reply message containing data indicative of at least one command function status of the remote locomotive;

transmitting a help command message from the lead locomotive if the lead locomotive does not receive the status reply message within a predetermined period of time after broadcasting the command message;

transmitting a help reply message from the remote locomotive in response to the remote locomotive's receipt of the help command message;

repeating the help reply message from a remote locomotive consist of the train consist; and receiving the repeated help reply message at the lead locomotive, the repeated help reply message containing data indicative of the at least one command function status of the remote locomotive.

11. The method of claim 10, further comprising:

repeating the help command message from the remote locomotive consist to the remote locomotive.

12. The method of claim 11, the remote locomotive consist comprising a first locomotive and a second locomotive wherein the help command message is repeated by the first locomotive and the help reply message is repeated by the second locomotive.

13. The method of claim 11 wherein the help command message and the help reply message are repeated by a first locomotive of the remote locomotive consist.

14. The method of claim 10, further comprising:

linking a first radio unit in the lead locomotive with a second radio unit in the remote locomotive;

linking the first and the second radio units with a third radio unit in a first locomotive of the remote locomotive consist so that the first, second and third radio units are interoperable as part of a distributed power communication scheme to execute command functions included in the command message; and linking the first and second radio units with a fourth radio unit in a second locomotive of the remote locomotive consist so that the fourth radio unit functions as a repeater to repeat the help command message and the help reply message.

15. The method of claim 10 further comprising:

providing the lead locomotive with equipment configured to function as a control locomotive of a distributed power communication system operable among the plurality of locomotives;

providing a first locomotive of the remote locomotive consist with equipment configured to be in radio communication with the lead locomotive in order to execute command functions included in the command message, transmit a status reply message in response to receipt of the command message and repeat the command message; and providing a second locomotive of the remote locomotive consist with equipment configured to be in radio communication with at least the lead locomotive and the remote locomotive so that the second locomotive may repeat the help command message and the help reply message.

16. The method of claim 10 further comprising:

providing the lead locomotive with equipment configured for the lead locomotive to be a control locomotive of a distributed power communication system operable among the plurality of locomotives; and providing a first locomotive of the remote locomotive consist with equipment configured to be in radio communication with the lead locomotive in order to execute command functions included in the command message, transmit a status reply message in response to receipt of the command message, and repeat the command message, the help command message and the help reply message.

17. The method of claim 10 further comprising:

providing each of a first locomotive and a second locomotive of the remote locomotive consist with equipment configured to function in at least one of a first mode and a second mode;

wherein the first mode is configured so that the equipment operates in conjunction with the lead locomotive as part of a distributed power communication scheme so that at least one of the first and second locomotives executes command functions included in the command message;

wherein the second mode is configured so that the equipment operates in conjunction with the lead locomotive so that at least one of the first and second locomotives functions as a repeater of the help command message and the help reply message; and providing a control module in at least one of the lead locomotive, the first locomotive and the second locomotive for selectively switching the equipment between the first mode and the second mode.

18. The method of claim 10 further comprising:

providing each locomotive of the remote locomotive consist with distributed power communication equipment configured to be selectively switched between a distributed power communication mode, a help message repeater mode and a standby mode.

19. A method for communicating among a plurality of mobile assets and verifying receipt of a message by at least one of the mobile assets, the method comprising:

broadcasting a command message to the plurality of mobile assets;

determining whether a lead mobile asset receives a status reply message from each of a predetermined group of the plurality of mobile assets;

broadcasting a help command message if the lead mobile asset did not receive the status reply message from at least one of the predetermined group;

repeating the help command message by at least one of the plurality of mobile assets, the help command message including data indicative of the identity of the mobile asset for which the lead mobile asset did not receive the status reply message;

transmitting a help reply message from the mobile asset for which the lead mobile asset did not receive the status reply message, the help reply message being transmitted in response to the mobile asset's receipt of the help command;

repeating the help reply message from at least one of the plurality of mobile assets; and receiving the help reply message at the lead mobile asset.

20. The method of claim 19 wherein the help command message and the help reply message are repeated by the same mobile asset.

21. The method of claim 19 wherein the help command message and the help reply message are repeated by different mobile assets.

22. The method of claim 19 further comprising:

providing a first mobile asset with equipment configured to function as part of a distributed power communication scheme where the first mobile asset is under the control of the lead mobile asset; and providing a second mobile asset with equipment configured to function as a repeater of the help command message and the help reply message.

23. A system for a lead locomotive to verify that a remote locomotive under the control of the lead locomotive is following a set of command functions broadcast by the lead locomotive in a command message, the lead and remote locomotives being part of a train consist equipped with a distributed power communication system, the system comprising:

a control module for determining whether the lead locomotive has received a status reply message from the remote locomotive, the status reply message transmitted in response to the remote locomotive's receipt of the command message and including data indicative of at least one operational state of the remote locomotive;

a transmitter for transmitting a help command message from the lead locomotive to a locomotive consist within the train consist in the event the lead locomotive has not received the status reply message from the remote locomotive;

a radio unit for repeating the help command message from the locomotive consist to the remote locomotive;

a transmitter for transmitting a help reply message from the remote locomotive to the locomotive consist in response to the remote locomotive's receipt of the repeated help command message;

a radio unit for repeating the help reply message from the locomotive consist to the lead locomotive, the help reply message including data indicative of at least one operational state of the remote locomotive; and a receiver for receiving the help reply message at the lead locomotive thereby verifying that the remote locomotive is following the set of command functions.

24. The system of claim 23 further comprising:

a radio unit for repeating the help command message from a first remote locomotive of the locomotive consist.

25. The system of claim 24 further comprising:

a radio unit for repeating the help reply message from a remote trail locomotive of the locomotive consist.

26. The system of claim 23, the locomotive consist comprising at least a first remote locomotive and a remote trail locomotive, the system further comprising a radio unit for repeating the help command message and the help reply message from the remote trail locomotive.

27. The system of claim 23 further comprising:

a first control module on-board a first remote locomotive of the locomotive consist, the first control module configured for interoperability with the lead locomotive and the remote locomotive as part of the distributed power communication system; and a second control module on-board a remote trail locomotive of the locomotive consist, the second control module configured to function as a repeater of the help command message and the help rely message.

28. The system of claim 27 further comprising:

a control module configured to instruct the second control module on-board the remote trail locomotive to turn off the repeater function after the lead locomotive is in receipt of the help reply message.

29. The system of claim 23 further comprising:

a control module for controlling transmission of the help command message from the lead locomotive wherein the help command message is transmitted if the lead locomotive has not received the status reply message within a predetermined amount of time after broadcasting the command message.

30. The system of claim 23 further comprising:

a first control module on-board a first remote locomotive of the locomotive consist, the first control module configured to be selectively switched between a distributed power communication mode, a help message repeater mode and a standby mode; and a second control module on-board a second remote locomotive of the locomotive consist, the second control module configured to be selectively switched between a distributed power communication mode, a help message repeater mode and a standby mode.

31. The system of claim 30 further comprising:

a control module for linking a first radio unit in the lead locomotive with a first remote radio unit in the first remote locomotive and a second remote radio unit in the second remote locomotive; and a processor for selectively setting the first remote locomotive to function in the distributed power communication mode and the second remote locomotive to function in the help message repeater mode.

* * * * *